US006408580B1

(12) United States Patent
Jurvis et al.

(10) Patent No.: US 6,408,580 B1
(45) Date of Patent: Jun. 25, 2002

(54) SIDING SYSTEM

(75) Inventors: Erik K. Jurvis; Rochelle Gail Jurvis, both of Houghton Lake, MI (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/624,672

(22) Filed: Jul. 24, 2000

(51) Int. Cl.[7] ..... E04D 1/00

(52) U.S. Cl. ..... 52/233; 52/512; 52/519; 52/547; 52/551; 52/554

(58) Field of Search ..... 52/233, 478, 512, 52/519, 522, 526, 543, 547, 551, 552, 554, 557, 718.01, 718.04

(56) References Cited

U.S. PATENT DOCUMENTS

| | | | | | |
|---|---|---|---|---|---|
| 2,073,795 | A | * | 3/1937 | Haugaard | 52/385 |
| 2,110,787 | A | | 3/1938 | Brandjord | |
| 2,787,029 | A | | 4/1957 | Johnson | |
| 2,829,404 | A | | 4/1958 | Wilson et al. | |
| 3,417,531 | A | * | 12/1968 | Jones | 52/520 |
| 4,012,876 | A | | 3/1977 | Grubbs | |
| 4,104,841 | A | * | 8/1978 | Naz | 52/519 |
| 4,288,954 | A | | 9/1981 | O'Donnell | |
| 4,320,610 | A | | 3/1982 | Rupp | |
| 4,424,655 | A | * | 1/1984 | Trostle | 52/520 |
| 4,627,204 | A | | 12/1986 | Smith | |
| 4,640,069 | A | | 2/1987 | Felser | |
| 4,649,683 | A | | 3/1987 | Dolata | |
| 4,700,520 | A | * | 10/1987 | Ting | 52/478 |
| 4,777,773 | A | | 10/1988 | Fry | |
| 4,878,328 | A | | 11/1989 | Berge | |
| 4,967,526 | A | | 11/1990 | Yost | |
| 5,010,701 | A | | 4/1991 | Halsey, Jr. et al. | |
| 5,167,103 | A | | 12/1992 | Lindal et al. | |
| 5,181,358 | A | | 1/1993 | Mead | |
| 5,253,458 | A | | 10/1993 | Christian | |
| 5,271,878 | A | | 12/1993 | Mizia et al. | |
| 5,423,153 | A | | 6/1995 | Woolems et al. | |
| 5,537,791 | A | * | 7/1996 | Champagne | 52/520 |
| 5,586,422 | A | | 12/1996 | Hoffner | |
| 5,638,649 | A | | 6/1997 | Hovland | |
| 5,651,227 | A | * | 7/1997 | Anderson | 52/520 |
| 5,675,955 | A | * | 10/1997 | Champagne | 52/521 |
| 5,694,728 | A | | 12/1997 | Heath, Jr. et al. | |
| 5,735,099 | A | | 4/1998 | Anderson | |
| 5,787,661 | A | | 8/1998 | Sharp | |
| 5,878,542 | A | | 3/1999 | Cornelius | |
| 5,878,543 | A | * | 3/1999 | Mowery | 52/519 |
| 6,000,177 | A | | 12/1999 | Davidson | |
| 6,065,260 | A | * | 5/2000 | Dickey et al. | 52/547 |
| 6,070,376 | A | | 6/2000 | Asper | |
| 2001/0017020 | A1 | | 8/2001 | Kern | |

* cited by examiner

*Primary Examiner*—Carl D. Friedman
*Assistant Examiner*—Brian E. Glessner
(74) *Attorney, Agent, or Firm*—Inger H. Eckert; James J. Dottavio

(57) ABSTRACT

A siding system including an improved siding strip and a starter strip for assisting in attaching a first siding strip to a side of a dwelling or other stable mounting structure is provided. The siding strip includes at least one integral portion having the simulated appearance of grout or chinking. When two or more siding strips are placed adjacent to each other, this integral portion remains exposed such that the appearance of grout or chinking between the siding strips is simulated. The starter strip is provided with a C-shaped channel that receives a fastener portion or other part of a first siding strip in snap-fit engagement. As a result of this engagement, the starter strip may be inverted to begin installation of the siding strips at the top of a wall or other stable mounting structure while fully retaining its functionality.

20 Claims, 4 Drawing Sheets

SIDING SYSTEM

TECHNICAL FIELD AND INDUSTRIAL APPLICABILITY OF THE INVENTION

The present invention relates generally to the construction/wall covering art and, more particularly, to an improved siding system in which the appearance of grout or chinking between adjacent siding strips is simulated, and in which an improved starter strip is provided for affixing a first siding strip to a stable mounting structure, such as the sidewall of a dwelling.

BACKGROUND OF THE INVENTION

The art of constructing dwellings or like structures from natural logs or timbers is well known, and for many homeowners is desirable for the natural, rustic look and feel afforded by the resulting dwelling. Despite significant technological advances in recent years and the proliferation of commercial enterprises offering such services, constructing an entire dwelling from logs or timbers remains an expensive, time consuming and labor intensive proposition, requiring countless man hours and a great deal of natural resources to complete. In recent decades, a concern has also arisen over the excessive exploitation of natural resources, such as timber. This concern has prompted many in the construction art to switch to building materials fabricated of metal, vinyl, or the like. Another potential shortcoming is that, unless properly constructed by experts, dwellings formed of logs or timbers may lack the ability to contain properly conditioned air and keep out moisture, both of which may significantly increase the overall cost of owning such a dwelling.

As an alternative to using actual logs or timbers, others in the past have proposed various types of siding members, such as strips fabricated of vinyl or like materials, having outer surface indicia simulating the appearance of a natural log or timber. When a plurality of these siding strips are applied to the outside of a dwelling or other structure in an abutting or overlapping relationship, the appearance of a traditional log "cabin" is simulated, yet conventional construction materials are employed beneath the siding strips to provide the structural framework for the dwelling. As should be appreciated, siding strips formed of vinyl or the like are cheaper than wood per unit, easier to install, lighter in weight, relatively durable and generally resistant to the effects of moisture. Also, the use of conventional building materials beneath the siding strips (i.e., framed wall construction with insulation, an outer layer of wood sheeting, and an inner layer of drywall sheeting) improves the overall efficiency of the dwelling in terms of energy containment.

Despite these advantages, past proposals for vinyl siding are generally lacking in some key respects. For instance, it is desirable in some cases to provide siding that, when installed, provides a realistic simulation of an actual log cabin or like dwelling. Of course, conventional log cabins or dwellings usually include grout or a similar material between the logs or timbers, which typically has a white or light grey color. This grout is commonly referred to as "chinking" and not only serves to seal the interstitial space between the adjacent logs from moisture and the outside environment, but also creates contrasts between the adjacent pairs of logs that are considered by many to provide an aesthetically pleasing appearance to the overall structure.

In past proposals for simulated log siding or the like formed of vinyl, some have completely ignored the need for chinking (see, e.g., U.S. Pat. No. 5,181,358 to Mead and U.S. Pat. No. 5,694,728 to Heath, Jr. et al.), but the result is siding that fails to truly simulate the appearance of a log cabin and is therefore aesthetically unappealing to many homeowners. Others have sought to make the appearance more realistic either by placing plaster/caulking or affixing separate "chinking" strips between each adjacent pair of siding strips once installed in place (see, e.g., U.S. Pat. No. 4,288,954 to O'Donnell and later U.S. Pat. No. 6,000,177 to Davidson). In either case, this added step is disadvantageous, since it significantly adds to the installation time and concomitant expense. Since plaster or caulking tends to shrink, embrittle and separate from adjacent structures over time, frequent removal of the old material and reapplication may be required, which is obviously a time consuming and expensive undertaking. Also, the use of chinking strips is troublesome, since loosening or bowing may occur over time if the strips are not properly or reliably attached. Of course, like plaster or caulking, loose chinking strips increase the required maintenance effort for the homeowner, and if not kept in check, serve to degrade the overall appearance of the dwelling.

U.S. Pat. No. 5,010,701 to Halsey, Jr. et al. discloses a siding system wherein siding strips formed of solid wood are mounted in an overlapping, or "ship-lap," fashion. In this "ship-lap" embodiment, a portion of the member on one siding strip overlapped by an adjacent siding strip remains exposed and is recessed to provide a space or gap between the outer surfaces of the strips. According to the '701 patent, this recessed space or gap alone allegedly simulates the appearance of "chinking" between the siding strips. However, there is no mention of providing this recessed space between the overlapping siding strips with any coating or coloring that contrasts with the wood siding to simulate true grout or chinking, which of course is usually substantially white or light grey in color. Moreover, the siding strips in the '701 patent are formed of wood, rather than readily available modern building materials, such as vinyl, and therefore do not serve to limit the consumption of precious natural resources.

Another limitation in conventional siding strips generally is found in the "starter" strips used to attach the first siding strip to the corresponding wall surface or other stable mounting structure. The problem is that the starter strips generally: (1) do not serve to hold the corresponding first siding strip in the proper or desired position during affixation to the wall or structure; (2) cannot hold the first siding strip when inverted, which limits the flexibility afforded to the installer; or (3) otherwise do a poor job of holding the corresponding siding strip in place. For example, the "starter" strip disclosed in U.S. Pat. No. 5,878,542 to Cornelius merely includes an inverted U-shaped channel for receiving a corresponding flange on the siding strip in an abutting engagement. However, nothing supports the siding strip from the underside. This complicates installation, especially where particularly long strips of siding are employed, since nothing holds the strip in the proper position while the appropriate mechanical fasteners or adhesives are applied by the installer.

An earlier proposal for a similar "starter" strip is found in the above-referenced '728 patent to Heath, Jr. et al., but the only practical difference is that an upright U-shaped channel is employed. While this starter strip may serve to hold a siding strip in place during affixation to an adjacent stable mounting structure when positioned in the manner shown in the patent, it loses its functionality when inverted, which as noted above reduces the flexibility afforded to the installer.

Accordingly, a need is identified for an improved siding system that, among other things: (1) eliminates the need for applying separate chinking/grouting strips, plaster, or caulking between adjacent interlocking siding strips to simulate realistically the appearance of a log cabin or similar structure; and (2) eases the burden on the installer working with the siding strips in several respects, such as by eliminating the need for hurriedly applying the fasteners or adhesives used to affix the strips in place, as well as enhancing the flexibility afforded in the positioning of the strips.

SUMMARY OF THE INVENTION

The present invention is an improved siding system, including: (1) a siding strip including an integral portion, preferably having a contrasting color as compared to a main or body portion of the siding strip, that remains exposed when positioned adjacent to a second siding strip to simulate the appearance of grout or chinking between the strips; and (2) an improved starter strip for receiving, capturing, and holding a portion of a siding strip in place on a stable mounting structure prior to the application of a mechanical fastener or adhesive, even when the starter strip is installed in an inverted position.

In accordance with a first aspect of the invention, a first siding strip capable of engaging a second, adjacent siding strip to cover a portion of a stable mounting structure is provided. The strip comprises an elongated body including a main portion, a fastener portion, a fastener receiving section having a channel for receiving and capturing a fastener portion of the adjacent siding strip, and at least one first integral portion between the fastener receiving section and the main portion for simulating the appearance of grout or chinking. Accordingly, when this siding strip is engaged by or placed adjacent to the second, adjacent siding strip, the first integral portion on the first siding strip remains exposed. This exposed portion thus simulates the appearance of grout or chinking between the siding strips without the need for applying plaster, caulking, or separate "chinking" strips.

In a preferred embodiment, the siding strips are adapted to simulate the appearance of logs on the side of a stable mounting structure, forming part of a dwelling, thereby giving the appearance that the dwelling is constructed in the same manner as a conventional log cabin. Accordingly, the main portion of the elongated body forming the first siding strip is provided with an outer surface on which the appearance of a log or timber is simulated. To further enhance the realism of the simulation, the main portion of the body may be outwardly bowed relative to a vertical plane. Preferably, the first integral grout or chinking portion is provided between the main portion having the simulated appearance of a log or timber and the channel of the fastener receiving section that receives the fastener portion of the adjacent siding strip. This ensures that the chinking portion remains exposed when the adjacent siding strip is in engagement with the first siding strip, In addition to the channel, the fastener receiving section also preferably further includes a substantially flat plate having at least one aperture. This aperture is adapted for receiving a mechanical fastener that serves to affix the siding strip to the sidewall of a dwelling or other stable mounting structure.

In a most preferred embodiment, the channel in the fastener receiving section is substantially C-shaped and includes a lip (projecting outwardly or inwardly, as desired), an upstanding wall, and an outwardly projecting flange partially covering the channel. Together, the lip and flange define an opening for receiving the fastener portion of the adjacent siding strip. The fastener portion of the first siding strip may take the form of an upwardly projecting or upstanding flange adapted for insertion in a channel formed in either a fastener receiving section of a third adjacent siding strip or a starter strip. Preferably, this channel is identical to the one previously described, and as a result serves to capture the corresponding fastener portion of the first siding strip and securely hold it in place.

In accordance with a second aspect of the invention, a siding strip capable of engaging an adjacent siding strip to cover a portion of a stable mounting structure is provided. The siding strip comprises an elongated body including a main portion, a fastener portion, a fastener receiving section, and at least one first integral portion having a substantially white, light grey, or other light-colored contrasting surface for simulating the appearance of grout or chinking. Accordingly, when the two siding strips are placed adjacent to each other on the stable mounting structure, the contrasting first integral portion is exposed when the adjacent siding strip is engaged to simulate the appearance of grout or chinking between the adjacent strip and the main portion.

In accordance with a third aspect of the invention, a system for applying siding to a stable mounting structure is disclosed. The system comprises a first siding strip including a main portion, a first fastener receiving section having a channel and being adapted to receive at least one fastener for securing the first strip to the stable mounting structure, and at least one first integral portion between the main portion and the fastener receiving portion for simulating the appearance of grout or chinking. A second siding strip including a fastener portion is also provided. In the mounted position, the fastener portion of the second siding strip is received and captured in the channel formed in the fastener receiving section of the first siding strip. In this position, however, the first integral grout or chinking portion of the first siding strip remains exposed, such that the appearance of grout or chinking between the siding strips is realistically simulated.

In the preferred embodiment, the main portion of the first siding strip includes an outer surface on which the appearance of a log or timber is simulated. This main portion may be outwardly bowed relative to a vertical plane to simulate the shape of a log or timber. Preferably, the first integral grout or chinking portion is provided between the main portion having the simulated appearance of a log or timber and the channel of the first siding strip. Also, the fastener receiving section of the first siding strip further includes a substantially flat plate having an inner surface for abutting the stable mounting structure. This section also preferably includes at least one aperture adapted to receive the at least one fastener to hold the siding strip against the stable mounting structure. The channel provided in this section is also preferably substantially C-shaped and includes an inwardly projecting lower lip, an upstanding wall, and an outwardly projecting flange. Together, the lip and flange define an opening for receiving the fastener portion of the second siding strip. The fastener portion of the second siding strip comprises an upwardly projecting flange adapted for insertion in the channel of the first fastener receiving section.

Preferably, the first siding strip further includes a first fastener portion as well, and the system further includes or comprises a starter strip having a channel adapted for receiving this first fastener portion. Like the fastener portion for the second siding strip, the first fastener portion of the first siding strip is preferably an upwardly projecting flange. The channel on the starter strip is similar to the channel in the first siding strip in that it is substantially C-shaped, but may differ slightly in that an outwardly projecting angled lip and an outwardly projecting L-shaped flange are preferably provided. This lip and flange together define an opening for receiving the upwardly projecting flange of the first siding strip. As a result of the combined application of the starter strip and multiple siding strips formed in the manner described above, an inter-engaging system of siding strips is formed that advantageously provides the appearance of simulated log siding with grout or chinking between the strips without the need for applying plaster, caulking, or separate "chinking" strips.

In accordance with a fourth aspect of the invention, a starter strip for assisting in affixing at least one siding strip to a stable mounting structure is provided. This strip comprises an elongated body having a fastener receiving portion for positioning adjacent to the stable mounting structure and a substantially C-shaped channel having an opening for receiving a portion of the siding strip. The channel includes an outwardly projecting angled lip and an outwardly projecting substantially L-shaped flange for partially covering the channel. The lip and flange together capture and initially hold the siding strip in position adjacent to the mounting structure during installation.

Preferably, the fastener receiving portion is an upstanding plate having an inner surface for engaging an outer surface of the stable mounting structure in an abutting relationship and at least one aperture for receiving a fastener. Also, the C-shaped channel is preferably positioned below the fastener receiving portion in a nominal position, yet is capable of receiving, capturing and initially holding a portion of the first siding strip when the starter strip is inverted such that the fastener receiving portion is above the C-shaped channel.

DETAILED DESCRIPTION AND PREFERRED EMBODIMENTS OF THE INVENTION

Figure 1:
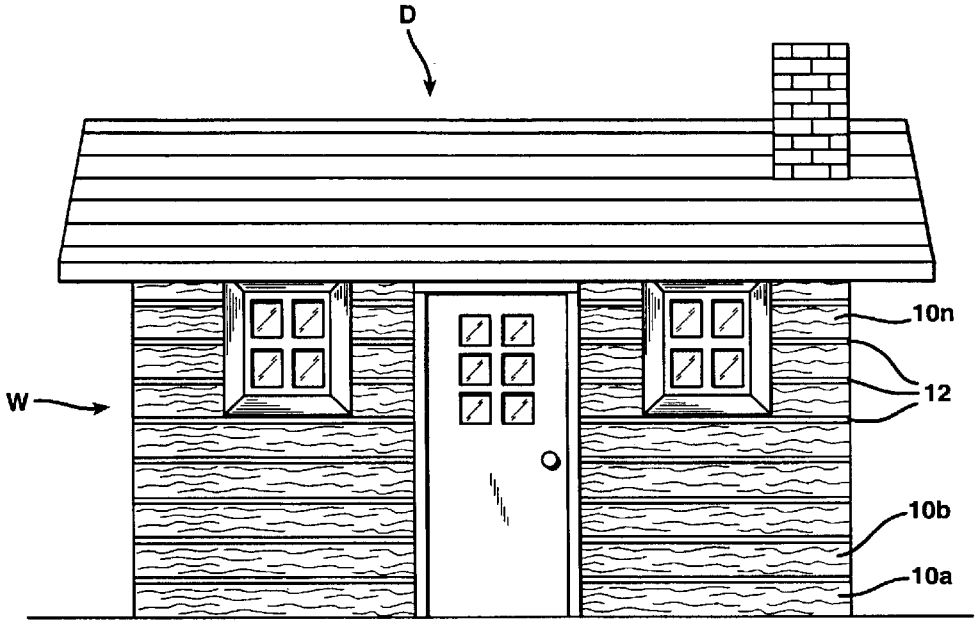
FIG. 1 is a front elevational view of a dwelling on which simulated log siding strips are applied such that the integral chinking portion provided on several of the siding strips is exposed to realistically simulate the appearance of a log cabin.

Reference is now made to FIG. 1, which illustrates a dwelling D comprising a stable mounting structure having a wall W (see also FIG. 3) or similar surface to which a plurality of siding strips 10*a* . . . 10*n* forming a part of the present invention are applied. As will be fully understood upon reviewing the description that follows, each siding strip 10*a* . . . 10*n* is preferably elongated and fabricated of vinyl, plastic, aluminum, a composite material such as a glass fiber reinforced polymeric material, or other well-known materials conventionally used to fabricate siding. The body of each strip 10*a* . . . 10*n* includes an integral portion 12 having a contrasting surface (preferably white or light grey) as compared with other portions of the strip and adjacent strips to simulate the appearance of grout or chinking. Thus, when each strip 10 is provided with a shape and/or surface indicia that simulates the appearance of a log, and the strips 10*a* . . . 10*n* are mounted in an abutting or overlapping fashion on the side of the stable mounting structure, the contrasting appearance of the exposed grout or chinking portion 12 between each strip 10 realistically simulates the appearance of a log cabin or like structure. The use of siding simulating logs and grout/chinking advantageously: (1) allows the siding to be made of readily available materials, such as vinyl, plastics, metals, or the like, thereby conserving precious natural resources; (2) eases the burden on the installer, since the step of applying separate grout or chinking between actual logs is eliminated; and (3) permits the dwelling to be made of conventional building materials, such as a fully insulated conventional framed construction, which in most cases serves to create a dwelling at a much lower cost in terms of labor and materials, as well as one having improved energy efficiency as compared with an actual log cabin constructed in a conventional manner.

Figure 2:
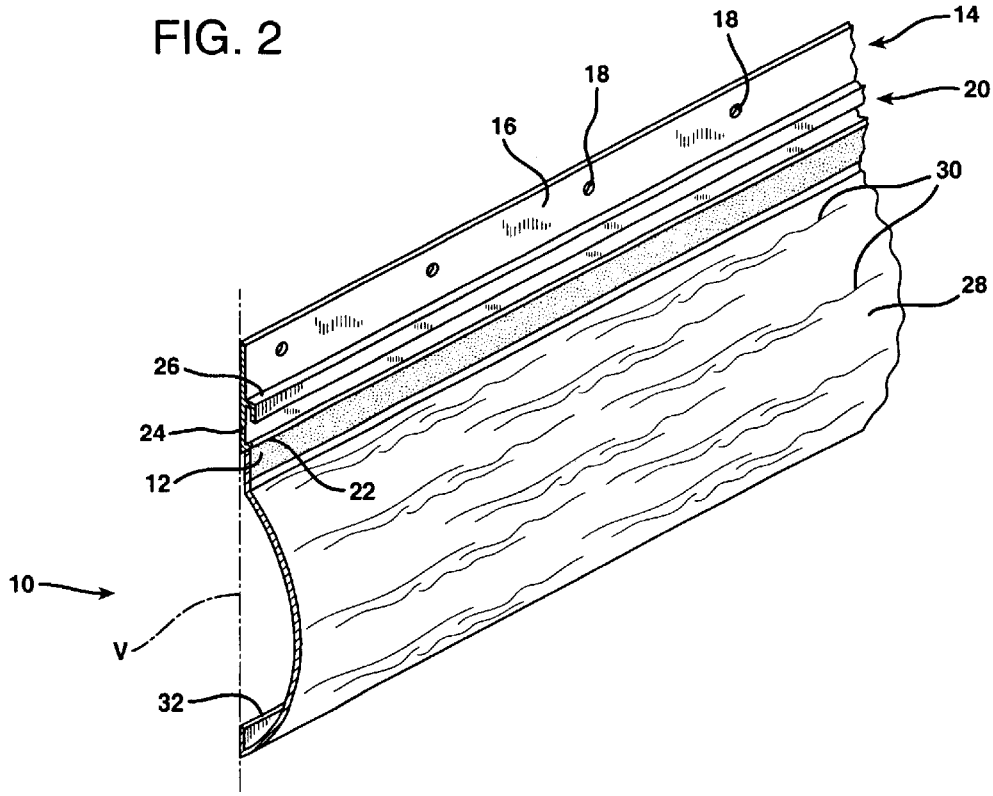
FIG. 2 is a partially cutaway perspective view of a most preferred embodiment of a siding strip for use as part of the overall siding system.

The above-described advantages of the present invention are provided in part by using the novel siding strip 10 shown in FIG. 2. Starting from the top of this figure, the siding strip 10 in the most preferred embodiment includes a first fastener receiving section 14 just above and preferably integral with the portion 12 having the simulated appearance of grout or chinking. The uppermost portion of the fastener receiving section 14 includes a substantially flat plate-like portion 16, or "nail plate" as such structures are commonly referred to in the art, having at least one, and preferably a plurality of apertures 18. These apertures 18 are adapted for receiving fasteners F (such as nails, see FIG. 3) for securing each siding strip 10 to the respective stable mounting structure, such as the wall W of a dwelling D. The rear surface of the fastener receiving section 14 is also substantially smooth and flat to abut in close engagement with the wall W or other stable mounting structure, which is especially important where adhesives are used to attach the siding strips 10*a* . . . 10*n* to the wall W. Of course, instead of nails, other types of fasteners, such as staples or screws, may be employed, which may obviate the need for using or forming the apertures 18 in the "nail plate" 16.

The fastener receiving section 14 of each siding strip 10 also includes a channel 20, preferably below the apertures 18 and immediately above the simulated grout or chinking portion 12. This channel 20 is adapted for receiving a portion of an adjacent siding strip (such as a fastener portion, to be discussed below, of siding strip 10*b* in FIG. 3). In the most preferred embodiment, the channel 20 includes a lower lip 22, which is shown as projecting inwardly at a downward angle (that is, toward the wall W relative to the outer surface of the integral portion 12), but is also capable of being formed as an outwardly projecting structure (that is, the integral portion 12 and plate-like portion 16 may be substantially aligned in the same vertical plane). Further, the channel 20 includes an upstanding rear sidewall portion 24 and an outwardly projecting, L-shaped upper flange 26. Together, the lip, wall, and flange define the channel 20 as having a C-shape with an opening for receiving the fastener portion or like structure on the adjacent siding strip 10*b* (see below). Furthermore, the lip 22 and the flange 26 together serve to capture the fastener portion or other structure on the adjacent strip 10*b* and thereby hold it securely in place, as explained in more detail in the description that follows. This secure engagement advantageously eases the burden on the installer when attempting to place the fasteners F (or adhesives or the like) in place to secure each siding strip 10 to the wall W or other stable mounting structure. Despite this description of the shape and relative positioning of the lip 22 and flange 26 for purposes of illustrating this most preferred embodiment, it should be appreciated that the position of these structures may be reversed, or the shapes changed, without changing the function provided, which is receiving and capturing a portion of an adjacent siding strip, such as siding strip 10*b*.

The most preferred embodiment of the siding strip 10 also includes a main portion 28 that is preferably integral with the portion 12 having the simulated appearance of grout or chinking. In the illustrated embodiment, this main portion 28 is provided with an outer surface having an indicia (i.e., a coating) and/or coloring (i.e., the materials forming the main portion is formed having the desired color) that simulates the appearance of a log or timber. Specifically, a plurality of randomly spaced, relatively narrow embossments 30 of random shapes and lengths are provided on this main portion 28. These embossments 30 in conjunction with the particular coloring selected give the appearance of the natural wood grain found in a log or timber with the outer bark removed or one that has been cut or sanded. To enhance the realism further, the main portion 28 is preferably outwardly bowed relative to a vertical plane V (see FIG. 2), thereby simulating the "half-round" shape of the outer surface of a log or timber of the type typically employed in constructing a conventional log dwelling, such as a cabin. Also, in addition to being provided with indicia and/or coloring of a contrasting color, such as white, light grey, or the like, the integral grout or chinking portion 12 may be provided with surface roughening or other indicia that further enhance the realistic nature of the appearance. Again, despite this description of a most preferred embodiment, it should be appreciated that this main portion 28 may be provided without wood-like coloring or surface indicia, may be substantially vertical, or may have colors or surface indicia different from that described above, depending on the particular desires of the market or those of a particular customer.

Each siding strip 10 also carries a fastener portion that assists in attaching the strip to the corresponding stable mounting structure, a starter strip, or an adjacent siding strip, whichever the case may be. In this most preferred embodiment, the fastener portion takes the form of a flange 32 projecting vertically upward from the lowermost point of the main portion 28. Preferably, the fastener portion or flange 32 is integrally formed with the main portion 28, so that the entire siding strip 10 is formed of a single unitary piece of material, such as vinyl, metal, or other plastic or polymeric materials that are easily formed into different shapes of the types described herein, yet are durable and long-lasting. However, providing any of the portions of the siding strip 10 as individual components that may be affixed together is of course also possible.

Figure 3:
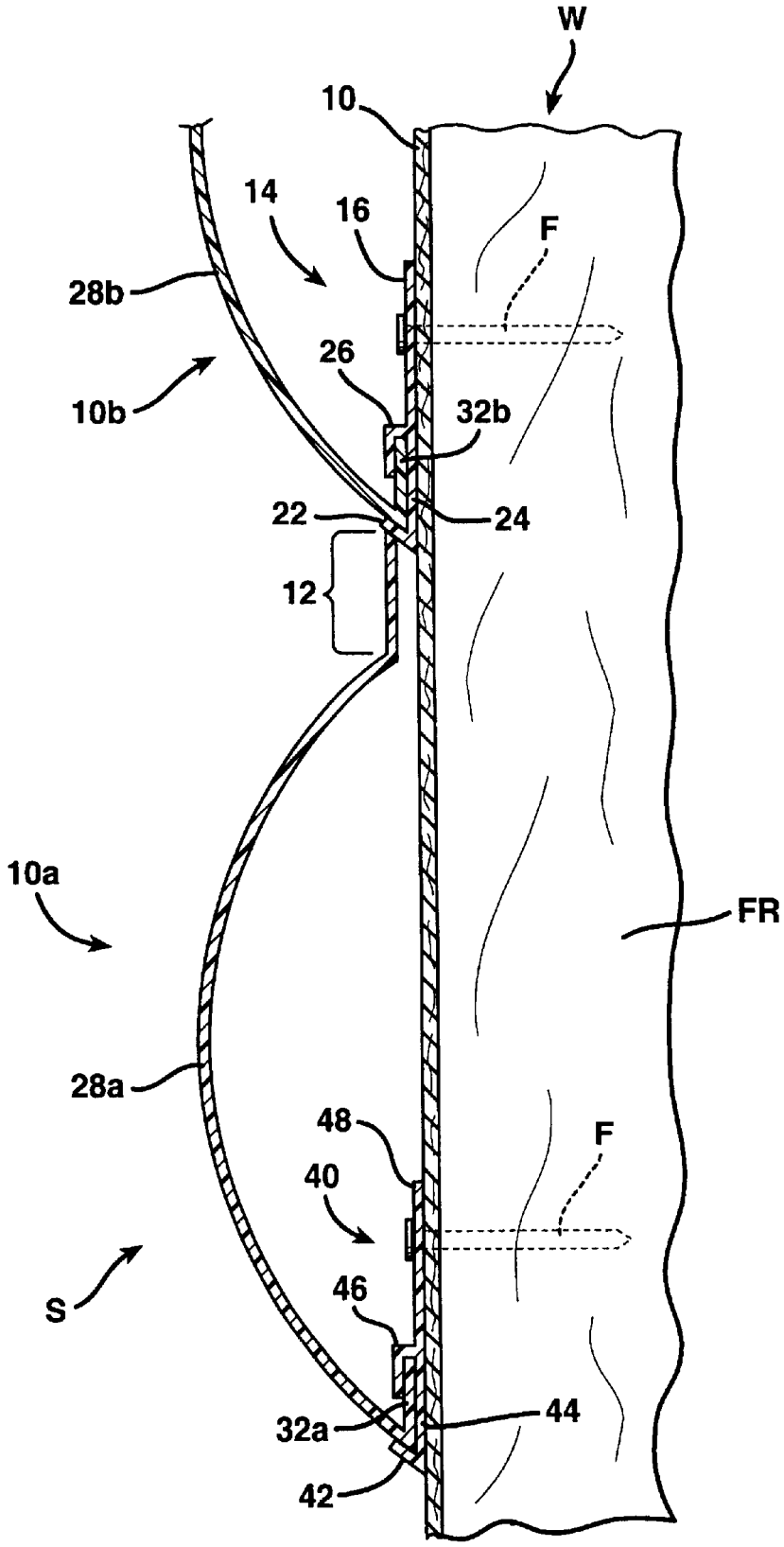
FIG. 3 is a partially cutaway cross-sectional side view showing a pair of adjacent siding strips inter-engaged to cover a stable mounting structure, such as the wall of a dwelling, with an integral portion of at least the first siding strip remaining exposed to simulate the appearance of grout or chinking between the strips, and further illustrating a starter strip affixed to the dwelling for receiving and capturing a lowermost portion of a first siding strip to hold it in place.
Figure 4:
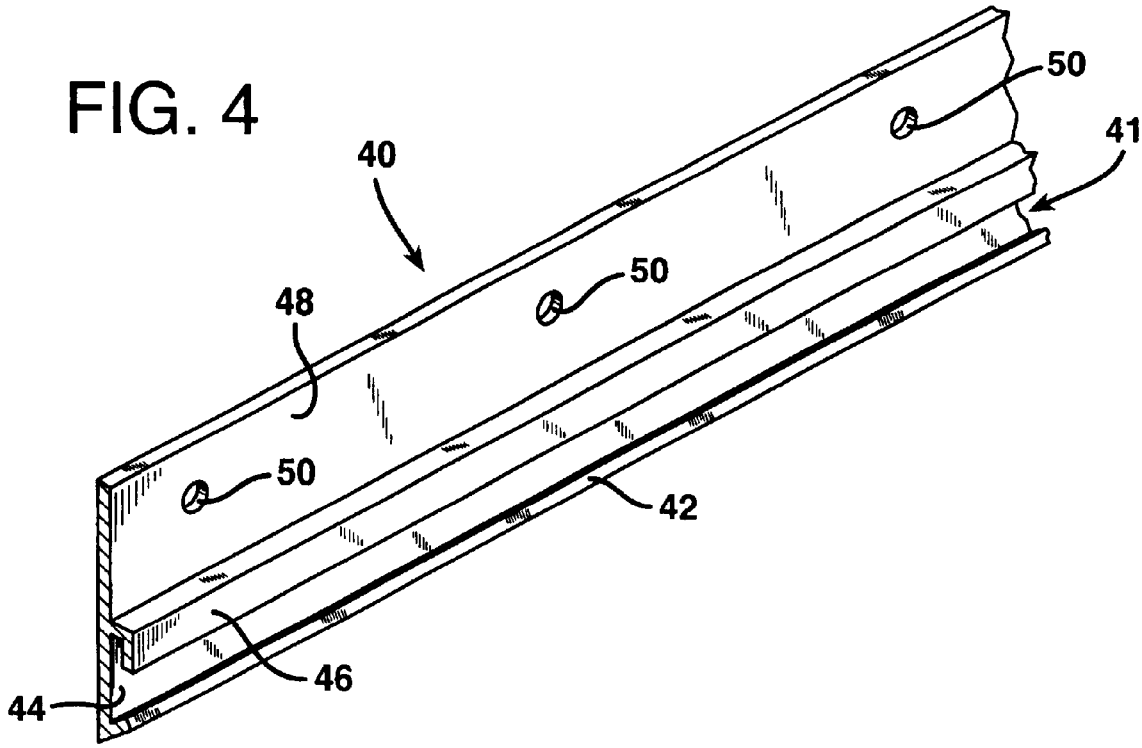
FIG. 4 is a partially cutaway perspective view of a starter strip for use in conjunction with the siding strips and overall system of the present invention.

To apply siding to the side of a dwelling D or other stable mounting structure, it is necessary to initially affix a first siding strip 10*a* in place. In many siding systems, this is conventionally done using a starter strip. FIGS. 3 and 4 illustrate a novel starter strip 40 particularly well-suited for use in conjunction with the siding strip 10 described above as the most preferred embodiment, but is also capable of use with other forms of siding strips. With specific reference first to FIG. 4, the strip 40 preferably includes an outwardly projecting angled lower lip 42, an upstanding rear wall 44, and an outwardly projecting L-shaped flange 46 which define a C-shaped channel 41 thus formed. Just above this C-shaped channel 41 in the illustrated embodiment, the starter strip 40 also includes a substantially flat plate-like portion 48 for receiving fasteners F, such as nails or the like. Preferably, a plurality of spaced apertures 50 are provided in this plate-like portion 48, each for receiving a fastener F, but of course may not be used in the case where staples or adhesives are employed instead. The rear surface of at least the plate-like portion 48 is substantially flat for closely abutting with the typically smooth outer surface of the wall W of the dwelling D or other stable mounting structure. As should be appreciated, this flat rear surface is particularly desirable where adhesives are used to apply the siding, either alone or in conjunction with nails, screws, staples, or other types of mechanical fasteners. The starter strip 40 may of course be fabricated of the same materials described above, or to provide enhanced rigidity, may be fabricated of relatively thin, lightweight, and low-cost durable and corrosion-resistant metals, such as stainless steel, aluminum, or the like (and alloys thereof). The siding strip 40 is also preferably colored similar to at least the first siding strip 10*a* such that the transition between the lower lip 42 and the adjacent strip 10*a* is virtually unnoticeable in the mounted position (see below).

Reference is now made specifically to FIG. 3 to describe the resulting overall siding system S created using a plurality of the siding strips 10*a* . . . 10*n* and the starter strip 40. First, the starter strip 40 such as that shown in FIG. 4 is positioned on the outside surface of the wall W, which in the conventional construction of a dwelling or other building is plywood sheeting P or the like affixed to framing FR formed of studs or other framing members. Fasteners F, such as nails, adhesives, or the like are then used to secure the starter strips 40 in position along the side of the wall W. Usually, the length of the starter strip 40 selected corresponds to the length of the siding strip 10 being supported, but the use of starter strips that are either longer or shorter than the siding strips 10 is of course also possible. Also, as is known in the art, both the starter strip 40 and the siding strips 10*a* . . . 10*n* may be cut to custom lengths to accommodate any openings in the wall W of the dwelling D, such those provided for the placement of a door or window.

Once the starter strip 40 is affixed in place, a first siding strip 10*a* is placed such that a portion thereof interfits in the C-shaped channel 41 formed therein. In the most preferred embodiment, this portion of the first siding starter strip 10*a* is the upstanding or upwardly projecting flange 32*a*. As shown in the lower portion of FIG. 3, this flange 32*a* may be inserted into an inverted U-shaped subchannel defined between the outwardly projecting L-shaped flange 46 and the wall 44 of the starter strip 40 when in the position shown in FIG. 3. By virtue of the inherent flexibility of the materials typically forming the siding strip 10 or the starter strip 40 (typically vinyls, thin metals or alloys, or other plastics or polymers), the flange 32*a* may be flexed relative to the main portion 28*a* to place the V-shaped lowermost comer of the siding strip 10*a* over the lower lip 42 forming a part of the C-shaped channel 41 in the starter strip 40 and/or the lower lip 42 may flex outwardly to receiving to V-shaped lowermost comer of the strip 10*a*, with the resulting snap-fit engagement locking the flange 32*a* securely in place. Usually in conjunction with the bending of the strip

10*a* itself, the L-shaped flange portion 46 and/or the lower lip 42, as noted previously, may flex slightly and then snap back into place once the flange 32*a* passes into engagement in the channel 41.

Advantageously, by securing the flange 32*a* in place all along the starter strip 40 (or strips, depending on the length of the siding strip 10*a*), the first siding strip 10*a* is thus securely held in place against the wall W of the dwelling D or other stable mounting structure. This secure mounting allows the installer to then focus on placing the fasteners F, adhesives, or both, on or through the corresponding portion of the fastener receiving section 14 of the first siding strip 10*a* to thereby fully secure it in place against the wall W of the dwelling D. This not only eases the burden on the installer(s), but may also allow the siding system 10 of the present invention to be installed more rapidly and using fewer manhours than conventional or known siding systems. Also, as should be appreciated, this engagement creates a passive, yet substantially fluid-impervious seal that protects the underlying structures, such as the plywood sheeting P, from damage related to the effects of moisture.

Once this first siding strip 10*a* is secured in place, a portion of a second siding strip 10*b*, such as fastener portion 32*b*, is inserted in the C-shaped channel 20 defined just below the fastener receiving section 14 of the first siding section 10*a* in this most preferred embodiment. Similar to the channel 41 in the starter strip 40, the flange 32*b* is inserted into the U-shaped subchannel defined by the relative positioning of the L-shaped flange 26 and the rear wall 24. Then, the lower corner of the second siding strip 10*b* is flexed (or alternatively or in combination the L-shaped flange 26 and/or lip 22 are flexed) such that the V-shaped corner passes through the opening. Upon passing, the resilient portions of either or both of the first siding strip 10*a* and second siding strip 10*b* snap back into place. Also as a result of this engagement, the desirable fluid impervious passive seal is also automatically created. This operation is completed as necessary until the entire second strip 10*b* is secured in the C-shaped channel 20 of the first siding strip 10*a*. As a result of this snap-fit engagement, the second siding strip 10*b* is thus fully supported, which therefore again allows the installer to focus on placing the fasteners F in or adhesives on the fastener receiving section (not shown) of the second siding strip 10*b*, which in the most preferred embodiment is identical in construction in all respects to the first siding strip 10*a*. This operation is repeatedly completed as necessary until all or the desired portion of the dwelling D is partially or fully covered, as desired.

As should be appreciated from viewing FIGS. 1 and 3 together, using the improved siding strips 10*a*, 10*b* formed in accordance with the teachings herein results in not only a secure and stable siding system S that eases the burdens on the installer(s), but also one in which the integral portion 12 of the strip 10, simulating the appearance of grout or chinking, is exposed between the main portions 28 of the adjacent siding strips 10. Thus, to an outside observer, as well as to the owner of the dwelling D when the siding system S is in place, the appearance of a seemingly realistic structure wherein grout or chinking is provided between the siding strips 10*a* . . . 10*n* is created. This simulated appearance is particularly appealing when the strips 10*a* . . . 10*n* are provided with indicia giving the appearance of or formed in the shape of logs or timbers, since the casual observer would believe, at least from a short distance, that a dwelling D formed of actual logs or timbers is present (see FIG. 1).

Another advantage is that, despite the realistic look and rustic feel, the simulation allows conventional building materials to be used. This saves natural resources, reduces the time and cost of construction, and saves energy, since the resulting dwelling can be formed using state-of-the-art building materials beneath the siding strips 10*a* . . . 10*n* (wood or metal framing, insulation, plywood sheeting, etc.). The overall result is a more stable, comfortable, and long-lasting dwelling D.

Figure 5:
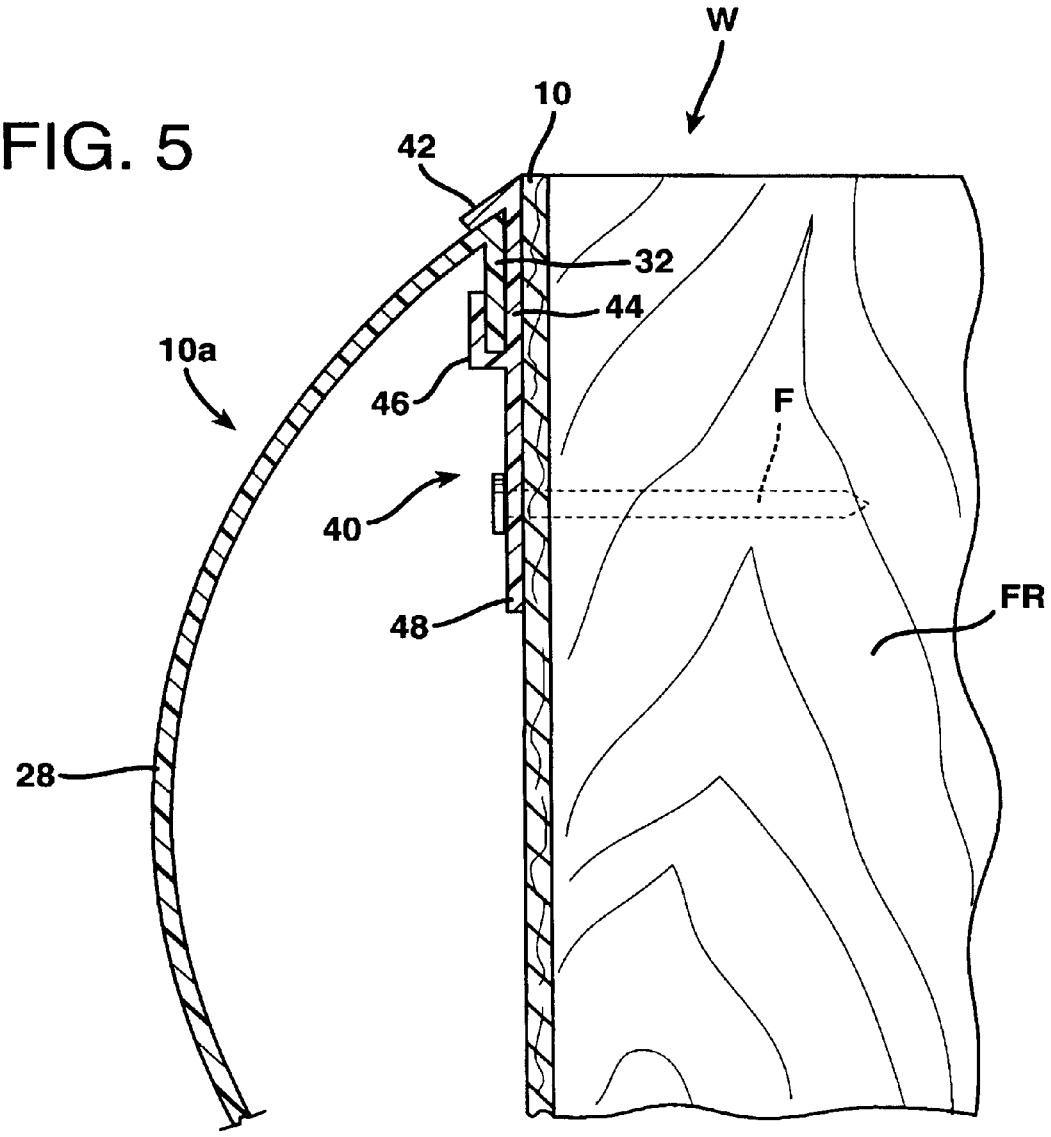
FIG. 5 is a partially cutaway cross-sectional side view of the starter strip illustrating that, despite being mounted in an inverted position, the strip is still capable of receiving and holding a first siding strip in place on the side of a stable mounting structure.

FIG. 5 illustrates another advantage afforded by the novel starter strip 40 of the present invention. Since the C-shaped channel 41 in the starter strip 40 formed by the lip 42 and flange 46 creates a snap-fit engagement, the starter strip 40 advantageously retains full functionality when inverted. This allows for the siding strip 10*a* to be placed at the top of a wall W or other stable mounting structure, rather than being started at the bottom, which is the conventional practice. As should be appreciated from reviewing the description of the prior proposals for starter strips described above, this affords a flexibility to the installer that is not found in other known siding systems or arrangements. Also, because the tight engagement with the first siding strip 10*a* is retained, the desired passive, yet fluid impervious seal is automatically created.

The foregoing description of a preferred embodiment of the present invention has been presented for purposes of illustration and description. It is not intended to be exhaustive or to limit the invention to the precise form disclosed. Obvious modifications or variations are possible in light of the above teachings. For instance, instead of providing an inwardly and downwardly projecting lip 22 in the fastener receiving section 14 of the strip 10, the lip may project outwardly at a positive angle, like lip 42 forming a part of the starter strip 40. Also, it is again reiterated that the shapes of the flanges 26, 46 and lips 22, 42 may be changed or their positions reversed without significantly effecting the overall functionality of the siding strip 10 or starter strip 40 disclosed herein; provided that a corresponding adjustment is made to the fastener or other portion of an adjacent siding strip that is received therein. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A siding strip capable of engaging an adjacent siding strip to cover a portion of a stable mounting structure, comprising:

an elongated body including a main portion, a fastener portion, a fastener receiving section having a channel for receiving and capturing a fastener portion of the adjacent siding strip, and at least one first integral portion between said fastener receiving section and said main portion having an outer surface simulating the appearance of grout or chinking, whereby said first integral portion on said siding strip is exposed when the adjacent siding strip is engaged to simulate the appearance of grout or chinking between the strips.

2. The siding strip according to claim 1, wherein the main portion of said body is provided with an outer surface on which the appearance of a log or timber is is simulated.

3. The siding strip according to claim 2, wherein said main portion of said body is outwardly bowed relative to a vertical plane to simulate the shape of a log or timber.

4. The siding strip according to claim 2, wherein the first integral grout or chinking portion is provided between said main portion having the simulated appearance of a log or timber and said channel of said fastener receiving section.

5. The siding strip according to claim 1, wherein the fastener receiving section further includes a substantially flat plate having at least one aperture for receiving a mechanical fastener, whereby the fastener serves to affix the siding strip to a stable mounting structure.

6. The siding strip according to claim 1, wherein said channel is substantially C-shaped and includes a lower lip, an upstanding wall, and a flange partially covering said channel, whereby said lip and flange together define an opening for receiving the fastener portion of the adjacent siding strip.

7. The siding strip according to claim 1, wherein the fastener portion includes an upwardly projecting flange, whereby said flange is adapted for insertion in a channel formed in a fastener receiving section of the adjacent siding strip.

8. A siding strip capable of engaging an adjacent siding strip to cover a portion of a stable mounting structure, comprising:

an elongated body including a main portion, a fastener portion, a fastener receiving section, and at least one first integral portion having an outer surface that contrasts in color with an outer surface of the main portion for simulating the appearance of grout or chinking, whereby said contrasting first integral portion is exposed when the adjacent siding strip is engaged with said elongated body to simulate the appearance of grout or chinking between the adjacent strip and the elongated body.

9. The siding strip according to claim 8, wherein the body is fabricated from a material selected from the group consisting of vinyl, aluminum, a glass fiber reinforced polymeric material, and combinations thereof.

10. A system for applying siding to a stable mounting structure, comprising:

a first siding strip including a main portion, a first fastener receiving section having a channel and being adapted to receive at least one fastener for securing said first strip to the stable mounting structure, and at least one first integral portion between said main portion and said fastener receiving portion having an outer surface simulating the appearance of grout or chinking;

a second siding strip including a fastener portion;

wherein said fastener portion of said second siding strip is received and captured in the channel formed in said fastener receiving section of said first siding strip while the first integral grout or chinking portion of the first siding strip remains exposed.

11. The siding system according to claim 10, wherein said main portion of said first siding strip includes an outer surface on which the appearance of a log or timber is simulated.

12. The siding system according to claim 11, wherein said main portion is outwardly bowed relative to a vertical plane to simulate the shape of a log or timber.

13. The siding system according to claim 11, wherein the first integral grout or chinking portion is provided between said main portion having the simulated appearance of a log or timber and said channel of said first siding strip.

14. The siding system according to claim 10, wherein the fastener receiving section of said first siding strip further includes a substantially flat plate having an inner surface for abutting the stable mounting structure and at least one aperture adapted to receive the at least one fastener to hold the siding strip against the stable mounting structure.

15. The siding system according to claim 10, wherein said channel is substantially C-shaped and includes a lip, an upstanding wall, and a flange, whereby said lip and flange together define an opening for receiving the fastener portion of the second siding strip.

16. The siding system according to claim 10, wherein the fastener portion of said second siding strip includes an upwardly projecting flange adapted for insertion in the channel of said first fastener receiving section.

17. The siding system according to claim 10, wherein said first siding strip further includes a first fastener portion;

said system further including a starter strip having a channel adapted for receiving said first fastener portion.

18. The siding system according to claim 17, wherein said first fastener portion of said first siding strip is an upwardly projecting flange and said channel on said starter strip is substantially C-shaped and includes an outwardly projecting angled lower lip and an outwardly projecting L-shaped flange, whereby said lip and flange together define an opening for receiving the upwardly projecting flange of the first siding strip.

19. A siding system for at least partially covering an outer surface of a stable mounting structure, comprising:

a siding strip having a flange portion and an adjacent outwardly bowed portion; and an elongated body having a fastener receiving portion for positioning adjacent to the stable mounting structure and a substantially C-shaped structure having an opening for receiving the flange portion of the siding strip, said C-shaped structure including a lip projecting outwardly from the body, said lip defining a first channel adapted for at least partially receiving and engaging the outwardly bowed portion of the siding strip, and an outwardly projecting substantially L-shaped flange defining a second channel adapted for receiving the flange portion of the siding strip, whereby said lip and flange forming said C-shaped structure together receive, capture and initially hold the outwardly bowed siding strip in position adjacent to the mounting structure during installation and, once installed, create a virtually invisible transition between the siding strip and the starter strip, wherein the lip projects outwardly at an acute angle from the body, wherein the angle selected corresponds to the degree of curvature of the outwardly bowed portion such that the siding strip fits into the first channel in a seating engagement.

20. The system according to claim 19, wherein said C-shaped structure is positioned below said fastener receiving portion in a nominal position, yet is capable of receiving, capturing and initially holding the outwardly bowed portion of the siding strip when said starter strip is inverted such that said fastener receiving portion is above said C-shaped structure.

* * * * *